US009048551B2

(12) United States Patent
Picaud et al.

(10) Patent No.: US 9,048,551 B2
(45) Date of Patent: Jun. 2, 2015

(54) CASING FOR AN ELECTRICAL CONNECTOR

(75) Inventors: Jean-Pierre Picaud, Eaubonne (FR); Bruno Dupont, Paris (FR)

(73) Assignee: Tyco Electronics France SAS, Pontoise (FR)

( * ) Notice: Subject to any disclaimer, the term of this patent is extended or adjusted under 35 U.S.C. 154(b) by 123 days.

(21) Appl. No.: 13/511,367

(22) PCT Filed: Nov. 5, 2010

(86) PCT No.: PCT/EP2010/066910

§ 371 (c)(1),
(2), (4) Date: May 22, 2012

(87) PCT Pub. No.: WO2011/061074

PCT Pub. Date: May 26, 2011

(65) Prior Publication Data

US 2012/0231676 A1 Sep. 13, 2012

(30) Foreign Application Priority Data

Nov. 23, 2009 (FR) ..... 09 58278

(51) Int. Cl.
*H01R 4/50* (2006.01)
*H01R 4/34* (2006.01)
(Continued)

(52) U.S. Cl.
CPC .. *H01R 4/34* (2013.01); *H01R 9/05* (2013.01); *H01R 11/12* (2013.01); *H01R 13/44* (2013.01);
(Continued)

(58) Field of Classification Search
CPC ..... H01R 13/5202; H01R 4/32; H01R 13/03
USPC ..... 439/808–810
See application file for complete search history.

(56) References Cited

U.S. PATENT DOCUMENTS 3,774,145 A * 11/1973 Vlahos ..... 439/715
4,202,591 A 5/1980 Borgstrom
(Continued)

FOREIGN PATENT DOCUMENTS

EP 0812031 A2 10/1997
EP 2112721 A1 10/2009
(Continued)

OTHER PUBLICATIONS

International Search Report and Written Opinion issued by the European Patent Office, dated Jan. 27, 2011, for related International Application No. PCT/EP2010/066910; 12 pages.
(Continued)

*Primary Examiner* — Briggitte R Hammond
(74) *Attorney, Agent, or Firm* — Faegre Baker Daniels LLP

(57) ABSTRACT

An electrical connector (2) housing (1) for connecting at least one cable lug (31) to a threaded terminal of an electrical device (4), including, for each lug, a hole (11) for receiving a screw (12) for retaining a lug in a threaded terminal, which hole has a lateral slot (13) designed to allow a lug to penetrate the hole, a lower opening (14) for connecting the lug to a threaded terminal and an upper opening (15) designed to allow the passage of a screwing tool for the screw, the size of the upper opening of the hole at its widest point being strictly less than the size of the hole at its widest point, said opening being designed so as to allow the passage of the screwing tool and having a section which is less than the section of a human finger.

20 Claims, 4 Drawing Sheets

(51) Int. Cl.

| | |
|---|---|
| ***H01R 11/12*** | (2006.01) |
| ***H01R 13/44*** | (2006.01) |
| ***H01R 13/447*** | (2006.01) |
| ***H01R 13/52*** | (2006.01) |
| ***H01R 13/53*** | (2006.01) |
| ***H01R 13/70*** | (2006.01) |
| ***H01R 13/707*** | (2006.01) |
| *H01R 9/05* | (2006.01) |
| *H01R 13/506* | (2006.01) |
| *H01R 13/73* | (2006.01) |
| *H01R 13/6599* | (2011.01) |

(52) U.S. Cl.

CPC ..... *H01R 13/447* (2013.01); *H01R 13/506* (2013.01); *H01R 13/5202* (2013.01); *H01R 13/5205* (2013.01); *H01R 13/53* (2013.01); *H01R 13/701* (2013.01); *H01R 13/707* (2013.01); *H01R 13/73* (2013.01); *H01R 2201/26* (2013.01); *H01R 13/6599* (2013.01)

(56) References Cited

U.S. PATENT DOCUMENTS

| | | | | |
|---|---|---|---|---|
| 4,527,849 | A * | 7/1985 | Marach | 439/591 |
| 6,544,072 | B2 * | 4/2003 | Olson | 439/607.02 |
| 7,041,921 | B2 * | 5/2006 | Kadan et al. | 200/293 |
| 7,077,676 | B2 * | 7/2006 | Matsumoto et al. | 439/271 |
| 7,084,361 | B1 | 8/2006 | Bowes et al. | |
| 7,530,843 | B1 | 5/2009 | Tesfay et al. | |
| 8,152,574 | B2 | 4/2012 | Matsuoka et al. | |
| 2007/0004260 | A1 * | 1/2007 | Drexler et al. | 439/188 |
| 2009/0017686 | A1 * | 1/2009 | Blum et al. | 439/620.1 |
| 2009/0149069 | A1 * | 6/2009 | Carcangiu et al. | 439/625 |

FOREIGN PATENT DOCUMENTS

| | | | |
|---|---|---|---|
| FR | 2865573 | A1 | 7/2005 |
| JP | 2000090910 | A | 3/2000 |
| WO | WO 2007/031175 | A1 | 3/2007 |
| WO | WO 2008/109109 | A1 | 9/2008 |
| WO | WO 2009060812 | A1 | 5/2009 |

OTHER PUBLICATIONS

International Preliminary Report on Patentability issued by the International Bureau of WIPO, Geneva, Switzerland, dated May 30, 2012, for related International Application No. PCT/EP2010/066910; 7 pages.

* cited by examiner

CASING FOR AN ELECTRICAL CONNECTOR

The present invention generally relates to electrical connectors.

More specifically, the present invention relates to electrical connector housings for connecting a cable lug to a threaded terminal by means of a screw.

In order to connect a plurality of cable lugs to threaded electrical terminals an electrical connector is generally used which has a housing with openings for the passage of cables and openings for electrically connecting the cable lugs to the threaded terminals using screws. The housings also have openings opposite the terminal openings for inserting and tightening these cable lug retention screws to the terminals.

Generally, in the field of electrical connectors, and in the field of high-voltage electrical connectors in particular, it is necessary to provide maximum protection of individuals against contact with electrical parts under voltage.

At the same time, the tightness of connectors must be provided in certain applications, notably in electric propulsion vehicles. In particular, when the housing is closed this involves ensuring that each channel of the connector is isolated in a sealed manner relative to the other connector channels in order to prevent a short circuit between the channels in the event of water ingress in the housing.

Numerous devices of this type are known which provide protection of individuals against electrical risks, whilst keeping the contacts isolated from the outside in a sealed manner.

In particular, a connector housing is known to this end which has an overall parallelepipedic shape forming a chamber for the lugs with lateral openings for the passage of electrical cables which terminate with lugs, and openings to a surface which is essentially perpendicular to the preceding surface for contacting the lugs with the terminals. The surface opposite the surface which has the openings for terminals is fully open to allow access to the chamber for installation and tightening of the screws to the threaded terminals. A cover which is retained by screws covers up this surface. Each opening is provided with a seal. The cover has a seal on its internal surface and sealed partition walls designed to partition off each channel inside the chamber in a sealed manner once the cover is closed.

In this type of housing, a contact device is provided for the protection of individuals, which contact device controls the cut-off of current upstream of the connector when the cover is removed. In general, this contact device is a micro-switch or two contact parts mounted to the housing and its cover respectively, which open an electrical circuit when the cover is open. However, this device may sometimes fail.

In effect, when the cover is removed the screws are directly accessible and in the event of the failure of the current cut-off device the screws continue to be supplied with current and this constitutes a risk to individuals.

Furthermore, once the cover is removed the seal between the channels is no longer provided.

Finally, this type of housing has numerous parts which make it costly in terms of manufacturing and onerous to assemble.

As a result of these observations, the general purpose of the present invention is to perfect electrical connector housings for connecting a cable lug to a threaded terminal in a known electrical device.

More specifically, the purpose of the invention is to provide a housing offering a high degree of protection for individuals by improving the channel-to-channel tightness of known solutions, whilst being simple, reliable and of robust construction and economic to manufacture, assemble and disassemble.

To this end, the invention proposes an electrical connector housing for connecting at least one cable lug to a threaded terminal of an electrical device, including, for each lug, a hole for receiving a screw for retaining a lug in a threaded terminal, which hole has a lateral slot designed to allow a lug to penetrate the hole, a lower opening for connecting the lug to a threaded terminal and an upper opening designed to allow the passage of a screwing tool for the screw, the size of the upper opening of the hole at its widest point being strictly less than the size of the hole at its widest point, said opening being designed so as to allow the passage of the screwing tool and having a section which is less than the section of a human finger.

The term human finger is understood to be a finger which has a diameter of at least 12 mm and a radius at its tip of approximately 4 mm, which essentially corresponds to the size of an average human finger.

In this way, and advantageously, the protection of individuals is vastly improved as, according to the invention, it is impossible for a human finger to make contact with a part under voltage. Furthermore, during disassembly, the screw cannot exit the hole via the upper opening or via the lower opening as long as the lug remains inside the hole: this reduces the risk of losing the screw during interventions on the housing.

Furthermore, channel-to-channel tightness is facilitated by the design of the housing according to the invention in so far as each lug is placed into a different hole independently. If a hole is flooded the other holes will not be affected, even if the cover is removed.

These provisions have an advantageous effect in terms of the reliability of the housing according to the invention.

According to advantageous features, possibly combined:

- the size of the upper opening of the hole taken at its widest point is less than or equal to 12 mm;
- the housing has a cover provided with sealing means designed to close the hole in a sealed manner.

The protection of individuals is thus improved and obtaining tightness is facilitated.

According to advantageous features, possibly combined:

- the lower opening of the hole has sealing means designed to co-operate with the device to be connected and the cover has fixing means designed to fix the cover to the device to be connected, so as to keep the housing fixed to the device via the cover in a sealed manner;
- the cover and/or the housing have contact means designed to control the cut-off of the current upstream of the connector when the cover is removed.

It can be seen that, even in the event of a failure in the current cut-off device, when the housing according to the invention is opened the risks to individuals are very limited as it is impossible for a finger to be inserted via the upper opening in the hole.

According to advantageous features, possibly combined:

- the slot of the hole opens onto a channel designed to receive the cable of the corresponding lug, said channel being provided with sealing means to provide the tightness between the cable and the housing;
- the channel has fixing means at its end for a sealing plug for passage of the cable in the housing and tight closure of the end of the channel;
- the hole has protrusions on its internal surface for maintaining the screw at a predetermined height so as to retain the screw between the end of the hole which has the upper opening and the slot, so as to keep the screw spaced apart from the slot when the lug is inserted;

the housing is provided with a fixing screw, the end of said fixing screw, which is opposite the screw head, has a tip covered with a cap in insulating material.

Also, advantageously, once disconnected the housing continues to effectively ensure the protection of individuals, since even if a finger is inserted into the lower opening there is no risk of an electric shock as it will encounter an insulating element.

According to an advantageous aspect:

the housing and/or the cover is made from a plastic material which is at least partially metallised so as to provide electrical shielding for the contents of the housing.

This provision advantageously reduces the costs of this device.

The invention further proposes, according to a second aspect, a process of connecting an electrical connector for connecting at least one cable lug to a threaded terminal of an electrical device including a housing as previously described, including steps consisting in:

introducing a retention screw via the lower opening with the tip presented towards the upper opening;

introducing a lug into the slot provided to this end;

presenting the connector opposite the terminals of the electrical device to be connected;

introducing a screwing tool via the upper opening;

pushing the screw by means of the tool until it engages in the thread of the terminal;

fixing the lug to the terminal by tightening the screw by means of the screwing tool.

The invention will be further explained by means of a detailed description of an embodiment, which is provided hereafter for illustrative and non-limiting purposes, with reference to the appended drawings, wherein.

Figure 1:
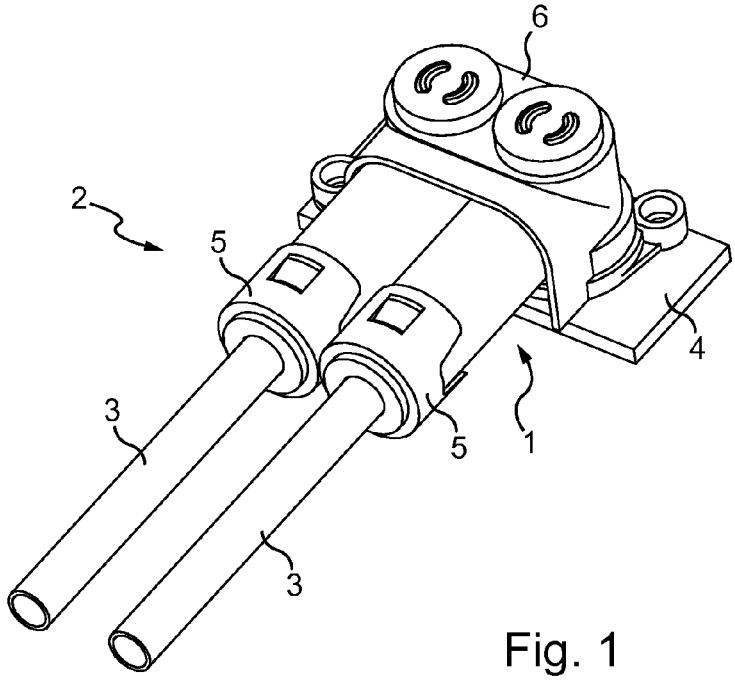
FIG. 1 is a perspective view of a connector provided with a terminal which has two holes according to the invention.

As can be seen in FIG. 1, a high-voltage electrical connector 2 has a housing 1 according to the invention. The connector allows two high-voltage cables 3 to be connected to an electrical device 4. There are sealing plugs 5 at the interface between the housing and the cables.

Figure 2:
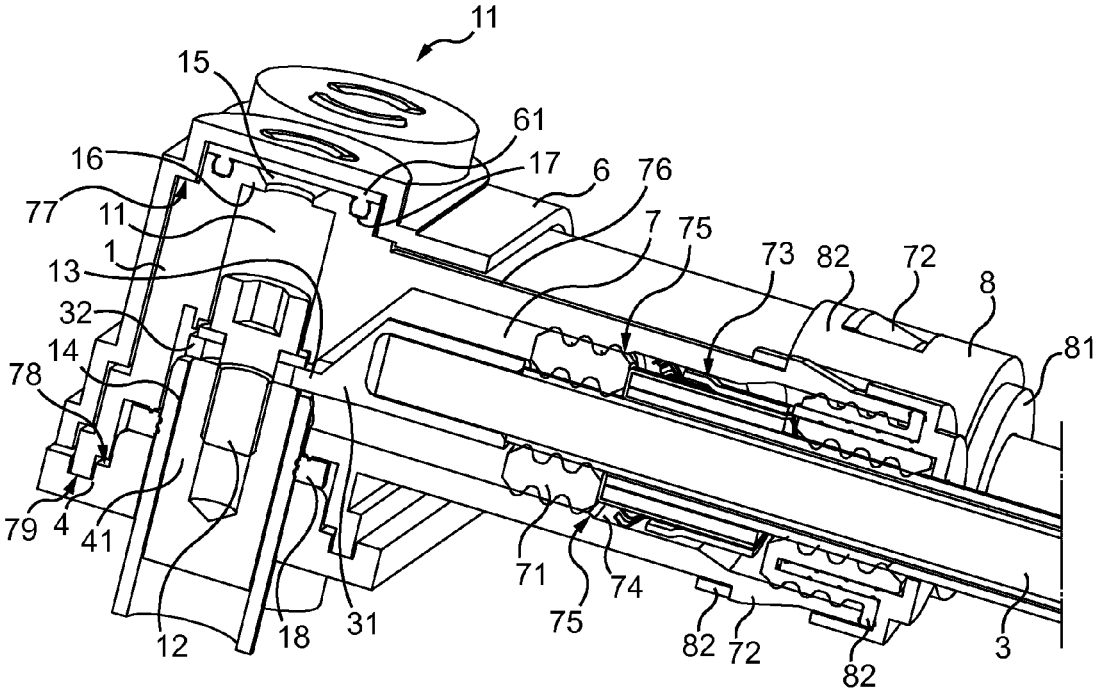
FIG. 2 is a longitudinal cut-out view of the connector of FIG. 1.

As can be seen more specifically in FIG. 2, the housing 1 is provided with a sealing cover 6.

The housing 1 allows the connection of a lug 31 to a threaded terminal 41 of the electrical device 4 to be connected.

Conventionally, the lug 31 is crimped to the end of the cable and has a connection ring 32.

The housing 1 has a hole 11 for each lug for receiving a retention screw 12. The hole 11 has a lateral slot 13 designed to allow the ring 32 of the lug to penetrate the hole.

The hole also has a lower opening 14 for connecting the lug to the threaded terminal 41 and an upper opening 15 designed to allow the passage of a screwing tool for the screw 12.

The diameter of the upper opening 15 of the hole is strictly below the diameter of the hole. The opening 15 is delimited by a collar 16 provided at the upper end of the hole.

In practice, the size of the upper opening of the hole at its widest point is less than or equal to 12 mm, which is sufficient to allow the passage of the tip of a screwing tool but effectively prevents an individual from inserting a finger into the hole.

The cover 6 is provided with seals 61 designed to sit in grooves 17 provided around the collars 16 to close each hole individually in a sealed manner.

The overall tightness is improved compared to the prior art, as when a single hole is flooded water cannot pass from one hole to another, even when the cover 6 is removed.

The lower opening 14 of the hole 11 has a specific seal 18 designed to co-operate with the device 4.

Figure 3:
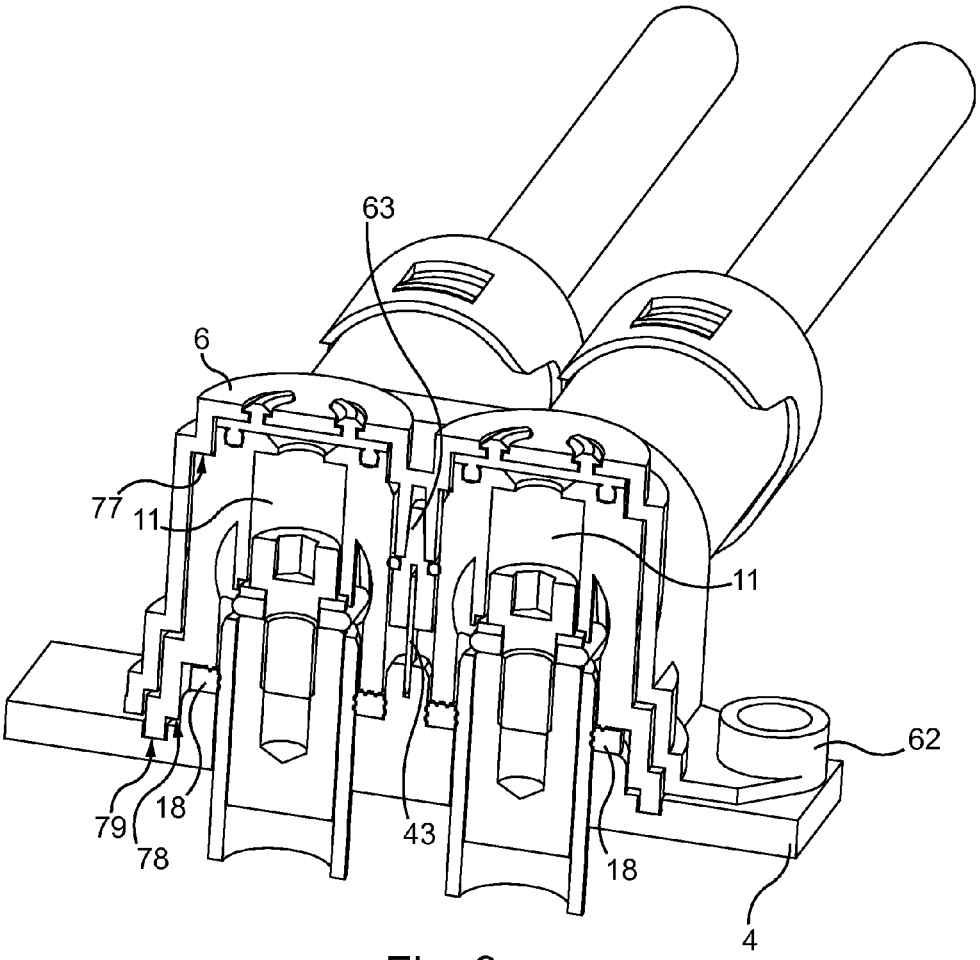
FIG. 3 is a transversal cut-out view of said connector.

As can be seen more specifically in FIG. 3 the cover has fixing means 62 designed to fix the cover 6 to the device 4. In practice, this involves a fixing ring 62 through which a fixing screw (not shown) extends which screws inside the body of the device 4.

In this way, the cover 6 maintains the housing 1 in a sealed manner against the device 4 by means of the seals 18 of each hole 11.

In a manner per se known, the cover has contact means designed to ensure that the current upstream of the connector is cut-off of when the cover is removed. This contact means is a metal ring 63 joined to the cover cooperating with a metal plate 43 mounted to the device to be connected. Opening of the cover causes the separation of the two metal elements and thus the opening of an electrical circuit which controls the cut-off of the current upstream of the connector.

Figure 4:
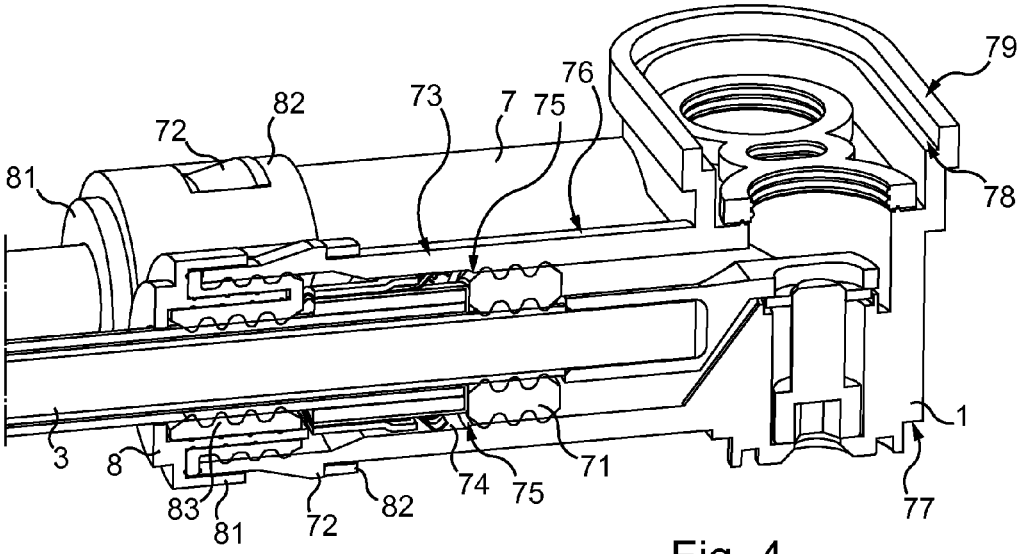
FIG. 4 is another longitudinal cut-out view of said connector.

As can be seen in FIG. 4, the slot 13 of the hole 11 opens onto a channel 7 designed to receive the cable 3 of the corresponding lug. This channel has a central seal 71 and a plug 8 at its opposite end.

The plug is constituted by a shell 81 which has two lobes 82 which are snapped on to two conforming tabs 72 provided to this end on the external surface of the channel 7. Inside the shell a seal 83 ensures tightness between the cable 3 and the channel 7.

In a manner per se known, the channel 7 has a shielding transmission zone 73 between the shielding cover of the cable 3 and the housing 1. In a manner well known to a person skilled in the art, the housing 1 is made from plastic material which is selectively metallised to provide continuity of the shielding.

As can be seen more specifically in FIG. 4, the channel 7 is metallised with an internal metal layer 74 which ends at the surface 75, before the seal 71.

Around the zone 73, the shielding cover of the cable 3 makes contact with the internal metal layer 74, as can be seen in FIGS. 2, 3 and 4.

This metal layer merges into an external metal layer 76 which extends along the external surface of the channel 7 up to the shoulder 77.

The continuity of the shielding on the channel 7 is provided by the cover 6, which is made from metal material.

This can be seen more clearly in FIG. 3 which shows that the continuity of the shielding between the metal cover 6 and the channel 7 is provided around the metallised shoulder 77.

The external metal layer 76 extends up to the shoulder 78 to the base of the hole 11, covering the edge 79.

The continuity of the shielding between the channel 7 and the metal cover of the electrical device 4 to be connected is made by means of the metal edge 79. This is more specifically visible in FIGS. 2 and 3.

Figure 5:
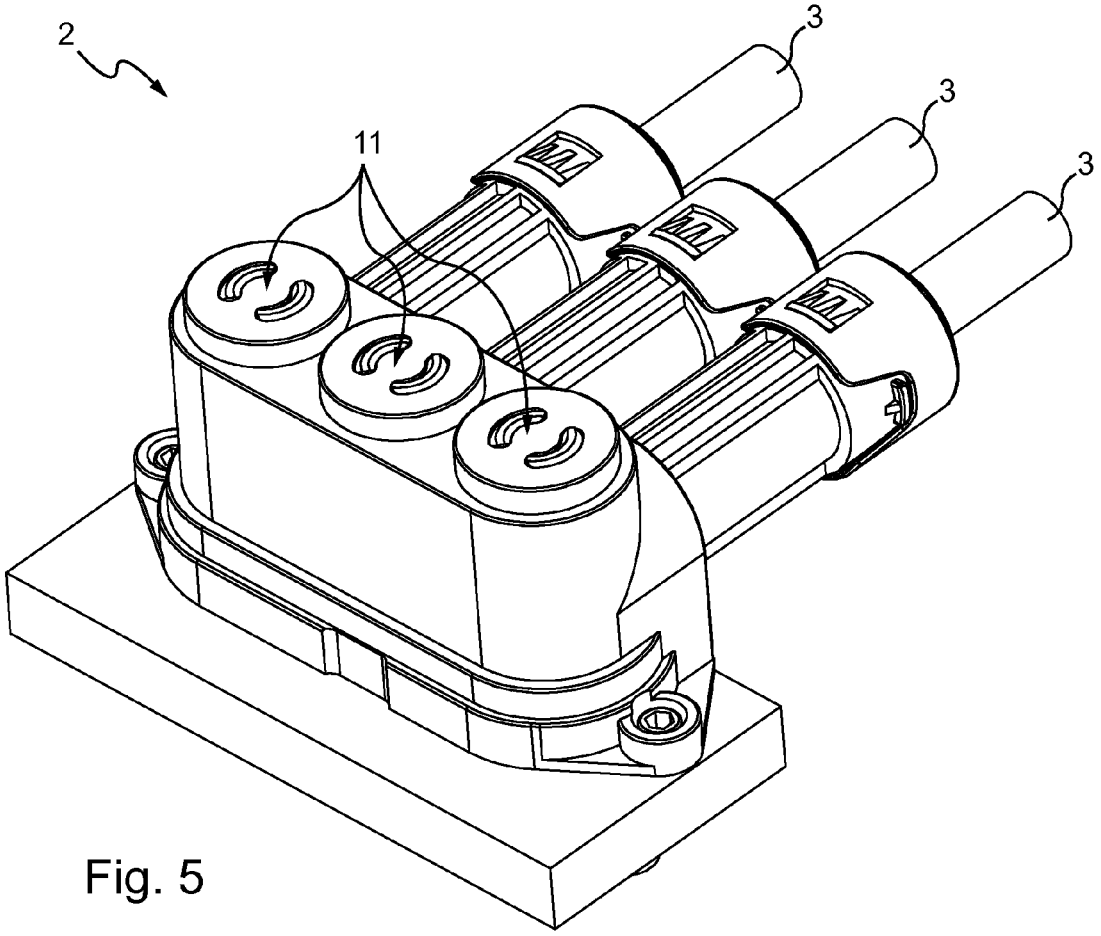
FIG. 5 is a perspective view of another connector provided with a housing which has three holes according to the invention.

A further embodiment is shown in FIG. 5, which shows a connector 2 with three holes 11 and three cables 3 which are in all points similar to those of the previously mentioned embodiment and which will not therefore be described in further detail.

Thus, the metallisation is ended on the channel 7 before the seals 71, 18 and 61. In this way, if the internal space of the channel 7 defined between these seals is flooded there is no line of current between the shielding and the conducting elements.

Figure 6:
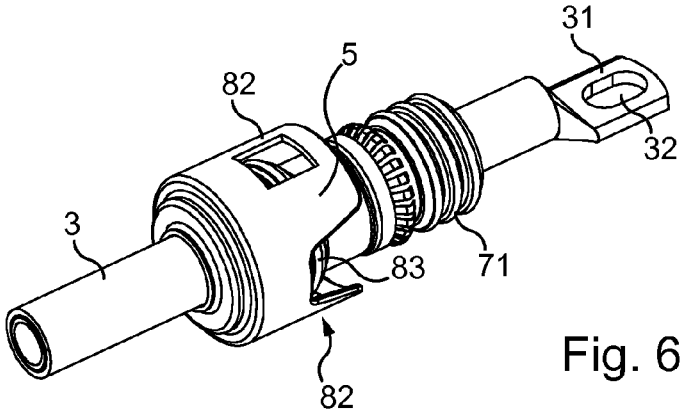
FIG. 6 is a perspective view of a cable provided with a lug and a plug of the connector of FIG. 5.

A portion of cable 3 provided with a lug 31 with a ring 32, according to the invention, is shown in FIG. 6. It is mounted in the same way in either of the embodiments of the housing previously described (having two or three channels).

A connector plug 5 is provided for the interface between the cables and the housing, it has two seals 83 and 71 and two lobes 82, as previously described.

Figure 7:
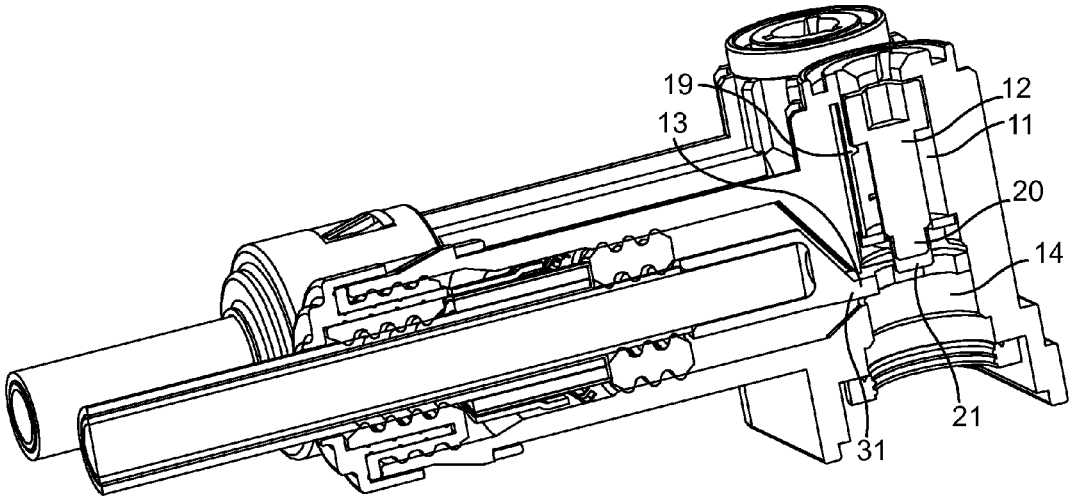
FIGS. 7 and 8 are two longitudinal cut-out views of the connector of FIG. 5 wherein a fixing screw is shown in two different positions respectively.
Figure 8:
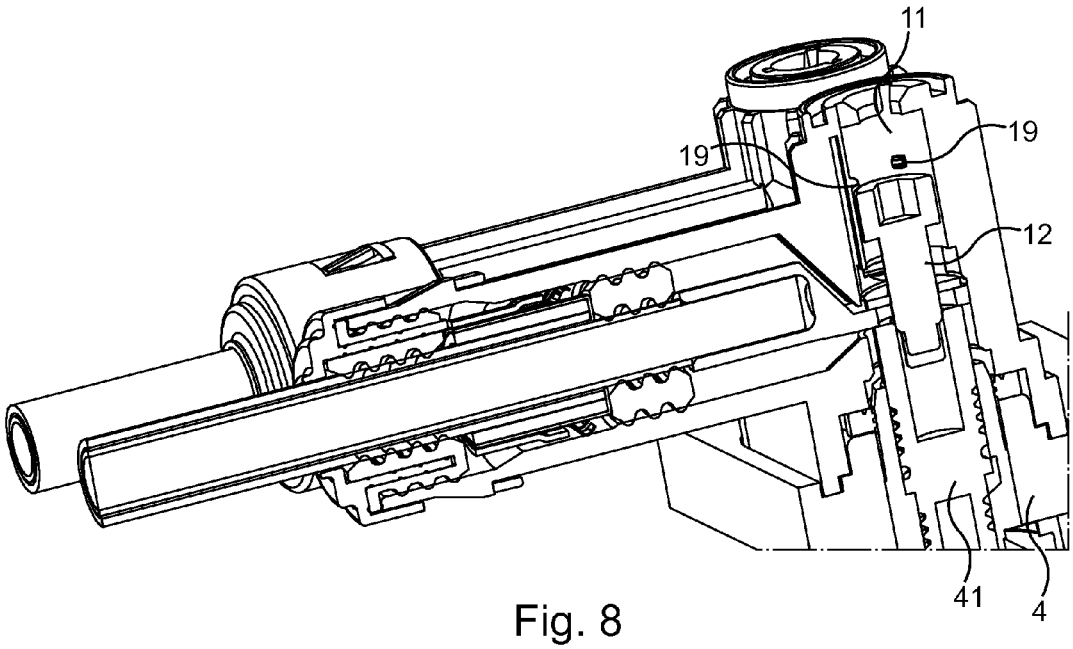

As can be seen more specifically in FIGS. 7 and 8, the hole 11 has protrusions 19 on its internal surface for maintaining the screw 12 at a predetermined height.

In this way, the screw is maintained between the end of the hole 11 which has the upper opening 15 and the slot 13, so as to keep the screw spaced apart from the slots and thus allow the insertion of the lug, as can be seen more specifically in FIG. 9.

In practice, when using a connector provided with a housing according to the invention, this involves in the first instance the introduction of the retention screw 12 via the lower opening 14 by presenting the tip towards the upper opening, until it passes over the protrusions 19. The screw is maintained above the slot 13 and the lug 31 is inserted into the hole via said slot.

As can be seen in FIG. 10, the connector is subsequently presented opposite the terminals 41 of the electrical device 4 to be connected.

Using a screwing tool (not shown) inserted via the upper opening 15, the screw 12 is pushed beyond the protrusions 19 and engages in the thread of the terminal 41. The lug is subsequently tightened to the terminal and the screwing tool is removed. In a final step, the cover 6 is installed and tightened via the ring 62, which can be seen in FIG. 3, to the body of the device 4.

Moreover, in the embodiment shown in FIGS. 9 and 10, the screw 12 has a tip 20 at its free end which is covered with a cap 21 made from insulating material.

In this way, even when the connector is disconnected from the device it maintains a high degree of safety and the possible insertion of a finger into the lower opening 14 does not constitute a risk as the first element encountered will be the insulating cap 21.

The invention is not limited to the examples of lugs as previously described but, on the contrary, covers all types of known lugs, such as, for example, "U" plate lugs and strong section "U" or "O" round lugs.

In general, numerous other variants are possible as a function of circumstances, and it should be noted in this respect that the invention is not limited to the examples described and shown.

The invention claimed is:

1. An electrical connector housing for connecting at least one cable lug to a threaded terminal of an electrical device, including for each lug, a tubular wall and an intersecting channel, the tubular wall having a hole for receiving a screw for retaining a lug in a threaded terminal, which tubular wall has a lateral slot communicating with the channel and designed to allow a lug to penetrate the hole from the channel, the tubular wall having at one end a lower opening for receiving the threaded terminal into the hole, whereby the lug may be connected to the threaded terminal, and the tubular wall having at an opposite end an upper opening designed to allow the passage of a tool for the screw, the size of the upper opening of the hole at its widest point being strictly less than the size of the hole at its widest point, said opening being designed so as to allow the passage of the tool and having a section which is less than the section of a human finger.

2. The housing according to claim 1, wherein the size of the upper opening of the hole taken at its widest point is less than or equal to 12 mm.

3. The housing according to claim 1, further comprising a cover provided with sealing means designed to close the hole in a sealed manner.

4. The housing according to claim 3, wherein the lower opening of the hole has sealing means designed to co-operate with the device to be connected and the cover has fixing means designed to fix the cover to the device to be connected, so as to keep the housing fixed to the device via the cover in a sealed manner.

5. The housing according to claim 3, wherein the cover and/or the housing have contact means designed to cut-off current upstream of the connector when the cover is removed.

6. The housing according to claim 1, wherein the slot of the hole opens onto a channel designed to receive the cable of the corresponding lug, said channel being provided with sealing means to provide tightness between the cable and the housing.

7. The housing according to claim 6, wherein the channel has fixing means at its end for a sealing plug for passage of the cable in the housing and tight closure of the end of the channel.

8. The housing according to claim 1, wherein the hole has protrusions on an internal surface for maintaining the screw at a predetermined height so as to retain the screw between the end of the hole which has the upper opening and the slot, so as to keep the screw spaced apart from the slot when the lug is inserted.

9. The housing according to claim 1, wherein the housing is provided with a fixing screw, the end of said fixing screw, which is opposite a screw head, having a tip covered with a cap made from insulating material.

10. The housing according to claim 1, further comprising a cover wherein the housing and/or the cover is made from a plastic material which is at least partially metallised so as to provide electrical shielding for contents of the housing.

11. A process of connecting an electrical connector for connecting at least one cable lug to a threaded terminal of an electrical device including a housing according to claim 1, comprising the steps of:

introducing a retention screw via the lower opening with a tip presented towards the upper opening;

introducing a lug into the slot provided to this end;

presenting the connector opposite the terminals of the electrical device to be connected;

introducing a tool via the upper opening;

pushing the screw by means of the tool until the screw engages in the thread of the terminal; and fixing the lug to the terminal by tightening the screw by means of the tool.

12. An electrical connector housing for connecting at least one cable lug to a threaded terminal of an electrical device, including for each lug, a hole for receiving a screw for retaining a lug in a threaded terminal, which hole has a lateral slot designed to allow a lug to penetrate the hole, a lower opening for connecting the lug to a threaded terminal and an upper opening designed to allow the passage of a tool for the screw, the size of the upper opening of the hole at its widest point being strictly less than the size of the hole at its widest point, said opening being designed so as to allow the passage of the tool and having a section which is less than the section of a human finger, and a cover provided with sealing means designed to close the hole in a sealed manner.

13. The housing according to claim 12, wherein the size of the upper opening of the hole taken at its widest point is less than or equal to 12 mm.

14. The housing according to claim 12, wherein the lower opening of the hole has sealing means designed to co-operate with the device to be connected and the cover has fixing means designed to fix the cover to the device to be connected, so as to keep the housing fixed to the device via the cover in a sealed manner.

15. The housing according to claim 12, wherein the cover and/or the housing have contact means designed to cut-off current upstream of the connector when the cover is removed.

16. The housing according to claim 12, wherein the slot of the hole opens onto a channel designed to receive the cable of the corresponding lug, said channel being provided with sealing means to provide tightness between the cable and the housing.

17. The housing according to claim 16, wherein the channel has fixing means at its end for a sealing plug for passage of the cable in the housing and tight closure of the end of the channel.

18. The housing according to claim 12, wherein the hole has protrusions on an internal surface for maintaining the screw at a predetermined height so as to retain the screw between the end of the hole which has the upper opening and the slot, so as to keep the screw spaced apart from the slot when the lug is inserted.

19. The housing according to claim 12, wherein the housing is provided with a fixing screw, the end of said fixing screw, which is opposite a screw head, having a tip covered with a cap made from insulating material.

20. The housing according to claim 12, further comprising a cover wherein the housing and/or the cover is made from a plastic material which is at least partially metallised so as to provide electrical shielding for contents of the housing.

* * * * *